US005577893A

United States Patent [19]

Nishikawa et al.

[11] Patent Number: 5,577,893

[45] Date of Patent: Nov. 26, 1996

[54] APPARATUS FOR VACUUM ABSORPTION HAVING REVERSE FLOW PROTECTION MECHANISM

[75] Inventors: Hidetoshi Nishikawa; Keigo Arimoto, both of Wakayama; Kunio Kanai; Masayuki Kurematsu, both of Hino, all of Japan

[73] Assignee: Noritsu Koki Co., Ltd., Wakayama, Japan

[21] Appl. No.: 386,806

[22] Filed: Feb. 6, 1995

[30] Foreign Application Priority Data

Feb. 16, 1994 [JP] Japan ..... 6-019470

[51] Int. Cl.[6] ..... F04F 5/48

[52] U.S. Cl. ..... 417/151; 417/182

[58] Field of Search ..... 417/151, 182, 417/184, 188

[56] References Cited

U.S. PATENT DOCUMENTS

| | | | |
|---|---|---|---|
| 970,232 | 9/1910 | Jakway | 417/182 |
| 2,381,589 | 8/1945 | Hayes | 417/182 |
| 4,838,307 | 6/1989 | Sasaki et al. | 417/151 |

FOREIGN PATENT DOCUMENTS

| | | | |
|---|---|---|---|
| 68819 | 3/1949 | Denmark | 417/188 |
| 1270215 | 6/1968 | Germany | 417/182 |
| 2346299 | 3/1975 | Germany | 417/182 |
| 122114 | 10/1978 | Japan | 417/184 |
| 777265 | 11/1980 | U.S.S.R. | 417/184 |
| 826092 | 4/1981 | U.S.S.R. | 417/182 |
| 4159 | 11/1912 | United Kingdom | 417/182 |

*Primary Examiner*—Timothy S. Thorpe
*Assistant Examiner*—Ted Kim
*Attorney, Agent, or Firm*—Armstrong, Westerman, Hattori, McLeland & Naughton

[57] ABSTRACT

An apparatus for vacuum absorption is provided which is quiet and simplified with maintaining an absorption power. The apparatus comprises: a tank for accumulating circulating water; a waterway for circulating the circulating water by a pump disposed at an absorption inlet side of the waterway and having an outlet disposed over the water surface of the circulating water in the tank; an aspirator disposed on the waterway; and a reverse flow prevention mechanism surrounding the outlet, having a small hole of the size to drain less volume of water than the volume flowing out of the outlet at the position sunk under the water, and comprising a buffer (hollow body) with drain windows at the position over the water surface. The apparatus serves to drain the circulating water into the water during the operation of the pump and to absorb air from the outlet into the vacuum vessel during the stoppage of the pump.

2 Claims, 16 Drawing Sheets

6
G
23
9
23a
21
A
21a

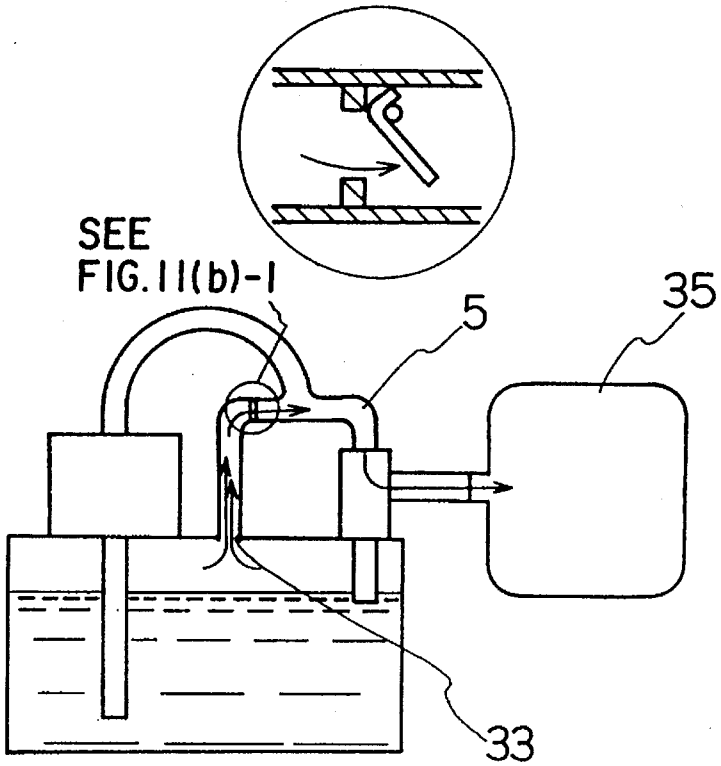
FIG. 11(b)-1
FIG. 11(b)
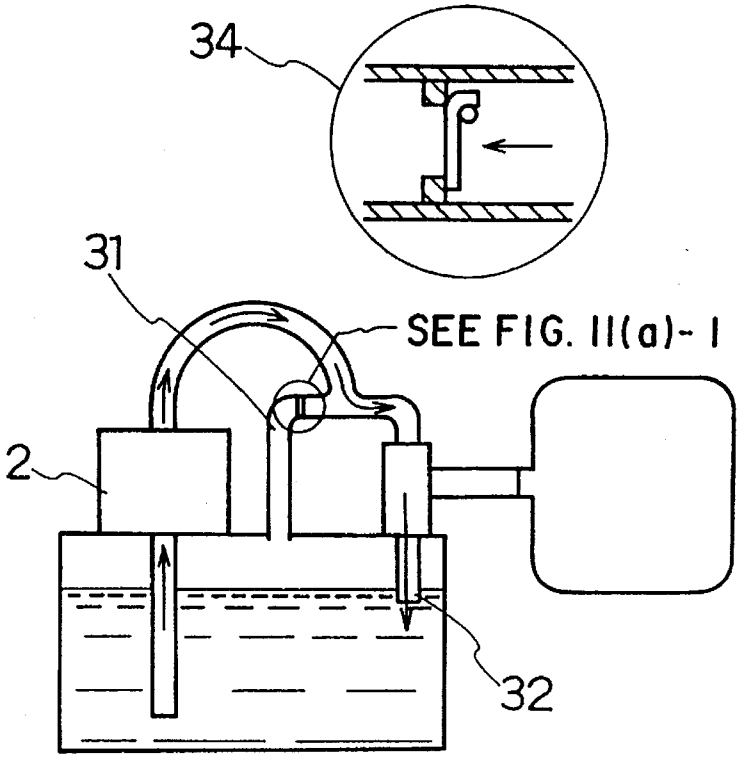
FIG. 11(a)-1
FIG. 11(a)

APPARATUS FOR VACUUM ABSORPTION HAVING REVERSE FLOW PROTECTION MECHANISM

BACKGROUND OF THE INVENTION

The present invention relates to an apparatus for vacuum absorption and, more particularly, to an apparatus for vacuum absorption provided with an aspirator in a waterway wherein water is circulated by a pump.

There has formerly been an apparatus which utilizes an aspirator as a device to evacuate the inside of a vacuum vessel. The aspirator is provided with a inner tube, which tapers off toward the downstream end, in a hose. At the sidewall of the inner tube, a absorption passage connecting to the vacuum vessel is provided. That is, an accelerated speed of a stream by the inner tube makes a low pressure portion around the stream, and therefore the absorption passage can evacuate the inside of the vacuum vessel because the absorption passage is open to the low pressure portion.

FIG. 13 shows a conventional apparatus for vacuum absorption 53 provided with an aspirator 52 in a waterway 51 wherein a water is circulated by a pump 50. The apparatus for vacuum absorption 53 stores circulating water in a tank 54, and a one-way mechanism, which can be opened only when air is evacuated in a vacuum vessel 55, is provided in an absorption passage 56 of the aspirator 52 to which the vacuum vessel 55 is attached. Therefore, an atmospheric open valve 57 is separately provided to return an inside of the vacuum vessel 55 to an atmospheric pressure.

As for the one-way mechanism, the holes 58, 59 are not closed by a ball, or globe, 60 when fluid flows to the left direction in the drawing, as shown in FIG. 14(*a*), while the hole 58 is closed by the globe ball 60 under the influence of pressure of the fluid when the fluid flows to the right direction in the drawing, as shown in FIG. 14(*b*). The conventional apparatus for vacuum absorption 53 can maintain a vacuum in the vacuum vessel 55 by such a one-way mechanism provided in the absorption passage 56 even after the fluid stops in accordance with a stoppage of the pump 50.

But, when the inside of the vacuum vessel is required to return to the atmospheric pressure in the case of removal of the vacuum vessel 55 from the aspirator 52 or so, some other means are necessary and therefore an atmospheric open valve 57 is provided.

As mentioned above, since the conventional apparatus for vacuum absorption has an one-way mechanism, an atmospheric open valve and a control means accompanied therewith, there is a problem that the system of the conventional apparatus for vacuum absorption is large-scale. Therefore, an apparatus for vacuum absorption is required to omit the one-way mechanism and the atmospheric open valve, and to simplify the system. However, as shown in FIGS. 15 and 16, the following problems respectively occur when providing an outlet under or over a water surface in an apparatus wherein an one-way mechanism and an atmospheric open valve are omitted.

That is, as shown in FIG. 15, when the outlet 61 is provided under a water surface, an outbreak of noise by the collision of circulating water drained from the outlet 61 with the water surface and a reduction of absorption power of an aspirator 52 by involvement of air are not caused (refer to FIG. 15(*a*)). But, there is the problem that an unpleasant sound of sipping water occurs because the circulating water flows reversely into the vacuum vessel from the outlet and the water level in the tank 54 lowers to the position at a tip of the outlet 61 when the pump is stopped (refer to FIG. 15(*b*)).

On the other hand, when the outlet 61 is provided over the water surface, circulating water is not likely to be directed into the vacuum vessel 55 from the outlet 61 when the pump 50 is stopped (refer to FIG. 16(*b*)). But, there is the problem that the absorption power of the aspirator 52 reduces because air is directed into the tank 54 and a large quantity of bubbles are generated (refer to FIG. 16(*a*)). There is also the problem that noise breaks out because the drain water from the aspirator 52 collides with the water surface of the tank 54.

In view of the foregoing, it is therefore an object of the present invention to provide an apparatus for vacuum absorption which is quiet and simplified in the system thereof while maintaining an absorption power.

SUMMARY OF THE INVENTION

According to the present invention, there is provided an apparatus for vacuum absorption comprising: a tank for accumulating circulating water; a waterway for circulating the circulating water by a pump disposed at an absorption inlet side of the tank; an aspirator disposed on the waterway; a reverse flow prevention mechanism for preventing the circulating water from flowing reversely into a vacuum vessel connected to the aspirator and for introducing fresh air from the aspirator into the vacuum vessel.

Preferably, the outlet of the waterway is disposed over the water surface of the circulating water in the tank, and the reverse flow prevention mechanism is disposed at the outlet and is allowed to drain circulating water into the water during the operation of the pump and to absorb air from the outlet into the vacuum vessel during the stoppage of the pump.

In that case, preferably, the reverse flow prevention mechanism includes the outlet, has a small hole of the size to drain less volume of water than the volume flowing out of the outlet at the position sunk under the water and comprises a hollow body with drain windows at the position over the water surface. The hollow body preferably has a wave prevention board at the outer side thereof, the board projecting along the water surface of the circulating water in the tank.

Otherwise, the reverse flow prevention mechanism preferably comprises a rubber tube so that the tip thereof might reach under the water surface during the operation of the pump and be sucked into the outlet by negative pressure of the vacuum vessel to turn over during the stoppage of the pump.

Further, the reverse flow prevention mechanism preferably comprises a flexible duct capable of advancing the tip thereof under the water surface during the operation of the pump and retreating over the water surface by a restoring force of itself during the stoppage of the pump.

For the above purpose, the duct is preferably in the shape of bellows, or the duct can comprise two plates each having a hole approximately at the center thereof and a flexible tube connecting the holes of the plate, and an elastic body provided between the plates.

Still further, the outlet of the waterway might be provided under the water surface of the circulating water in the tank, and the reverse flow prevention mechanism might comprise a bypass tube leading from the upstream side of the aspirator to the water surface in the tank, and a valve disposed in the bypass passing air only to the direction toward the aspirator. In that case, the valve can also be designed to open and close interlocking with a pump.

The apparatus for vacuum absorption of the present invention, can drain circulating water into the water during the operation of the pump and absorb air from the outlet during the stoppage of the pump by the reverse flow prevention mechanism.

When the outlet is disposed over the water surface of the circulating water in the tank and the reverse flow prevention mechanism comprises a hollow body with a small hole and a drain window, the water surface in the hollow body rises because the volume of water flowing out of the small hole into the tank is less than the volume of water drained from the outlet during the operation of the pump. Accordingly, the outlet sinks under the water surface. On the other hand, since the level of the water surface in the hollow body returns at once to the original level upon the stoppage of the pump, the outlet appears over the water surface and the air is absorbed into the vacuum vessel through the outlet. When the wave prevention board is provided at the outer side of this hollow body, it can prevent the swelling on the water surface generated by the circulating water overflowing from the drain window and the involvement of air into the current of the circulating water spouted out from a small hole into the water.

When the reverse flow prevention mechanism comprising the rubber tube is adopted, the tip of the rubber tube sinks under the water surface during the operation of the pump. But when the pump is stopped, the inside of the rubber tube is firstly touched firmly by negative pressure in the vacuum vessel and secondly sucked up toward the inside of the outlet disposed over the water surface. Then, the air is absorbed into the vacuum vessel through the turned-over rubber tube.

Further, when the reverse flow prevention mechanism comprising the flexible duct is adopted, the tip of the duct is extended under the water by the water pressure of the circulating water during the operation of the pump and is withdrawn over the water surface by a restoring force of itself upon the stoppage of the pump.

Still further, when the outlet is disposed under the water surface of the circulating water in the tank, a reverse flow prevention mechanism comprising a bypass tube and a valve is adopted, and air is, upon the stoppage of the pump, absorbed into the vacuum vessel through the bypass tube disposed from the upstream side of the aspirator to the water surface of the tank. The valve is opened by the negative pressure in the vacuum vessel or is opened and dosed interlocking with the pump.

BRIEF DESCRIPTION OF THE DRAWINGS

An apparatus for vacuum absorption according to the present invention will now be described in detail with reference to the drawings.

FIGS. 11(*a*) and 11(*b*) are schematic representations of action of the apparatus for vacuum absorption of FIG. 10;

FIGS. 11(*a*)-1 and 11(*b*)-1 are a blown up representation of the valve of FIGS. 11(*a*) and 11(*b*).

DETAILED DESCRIPTION

Figure 13:
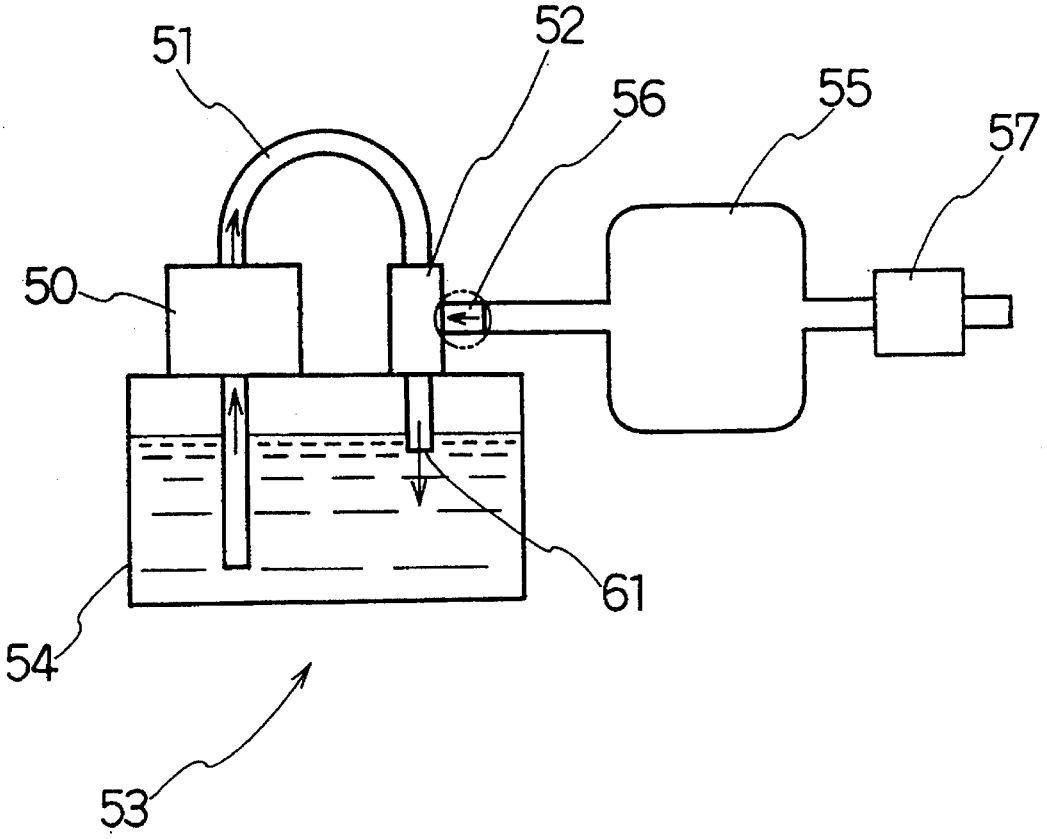
FIG. 13 PRIOR ART
FIG. 13 is a schematic representation of a conventional apparatus for vacuum absorption.

The different points between an apparatus for vacuum absorption according to the present invention and the prior art shown in FIG. 13 are the omission of the one-way mechanism disposed in the absorption passage 56 of the aspirator 52, the atmospheric open valve 57 disposed in the vacuum vessel 55 and the devices (not shown) accompanied with the atmospheric open valve 57, and the simplification of the system wherein the inside of the vacuum vessel 55 is kept under vacuum during operation of the pump 50 while it returns to the atmospheric pressure when the pump 50 stops. As for the constitution, there are two cases wherein the outlet is disposed over the water surface or under the water surface.

Figure 5:
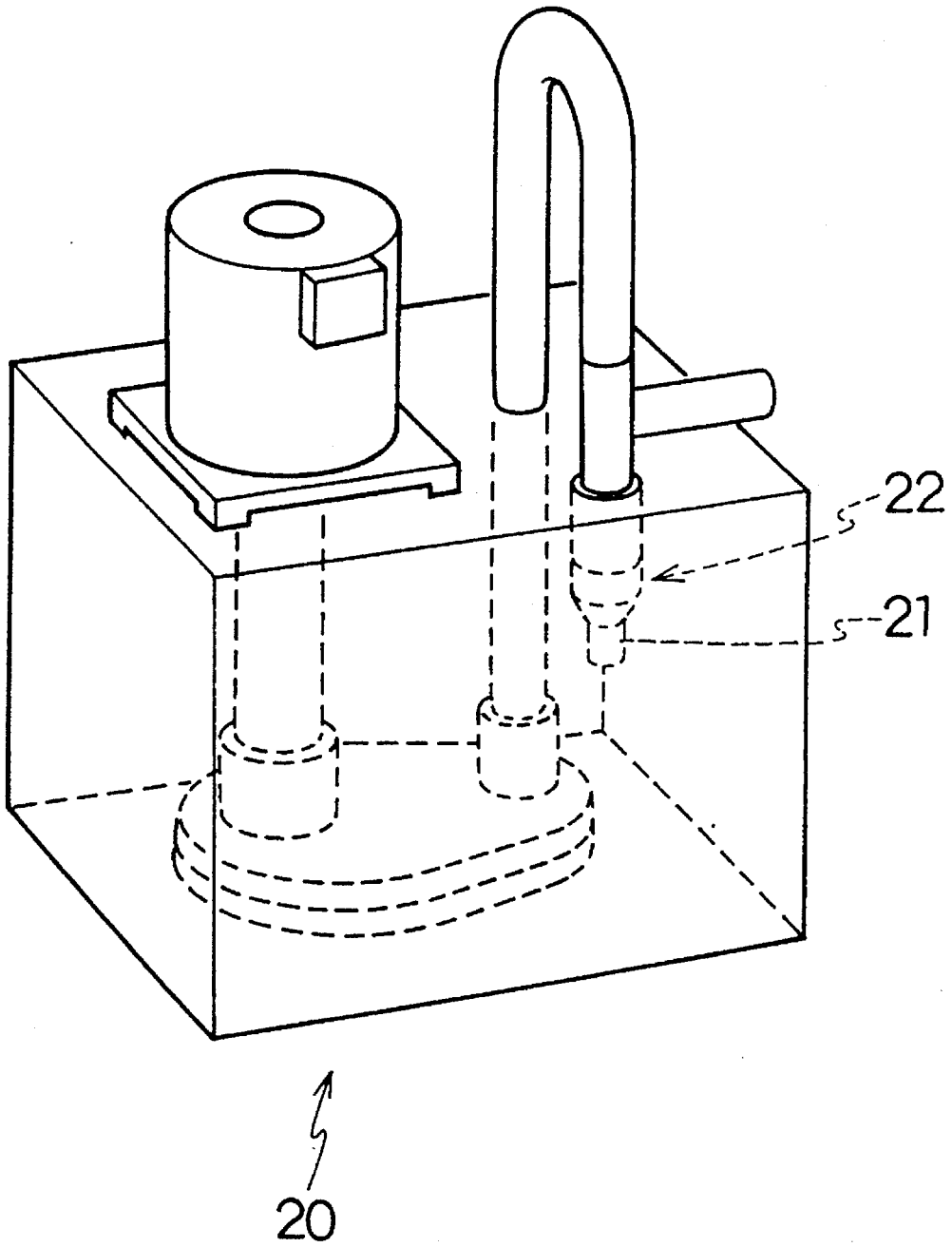
FIG. 5 is a perspective view of another embodiment of an apparatus for vacuum absorption according to the present invention.
Figure 6:
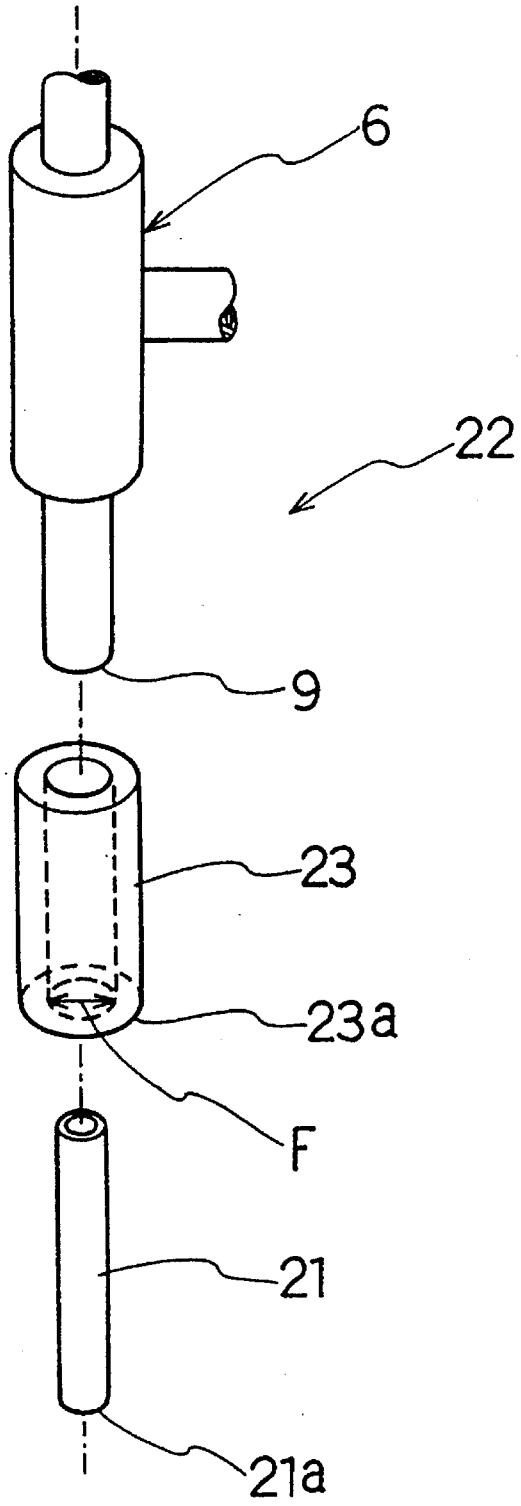
FIG. 6 is a perspective view before assembly of the reverse flow prevention mechanism of the apparatus for vacuum absorption of FIG. 5.
Figures 7A, 7B, 7C, 7D:
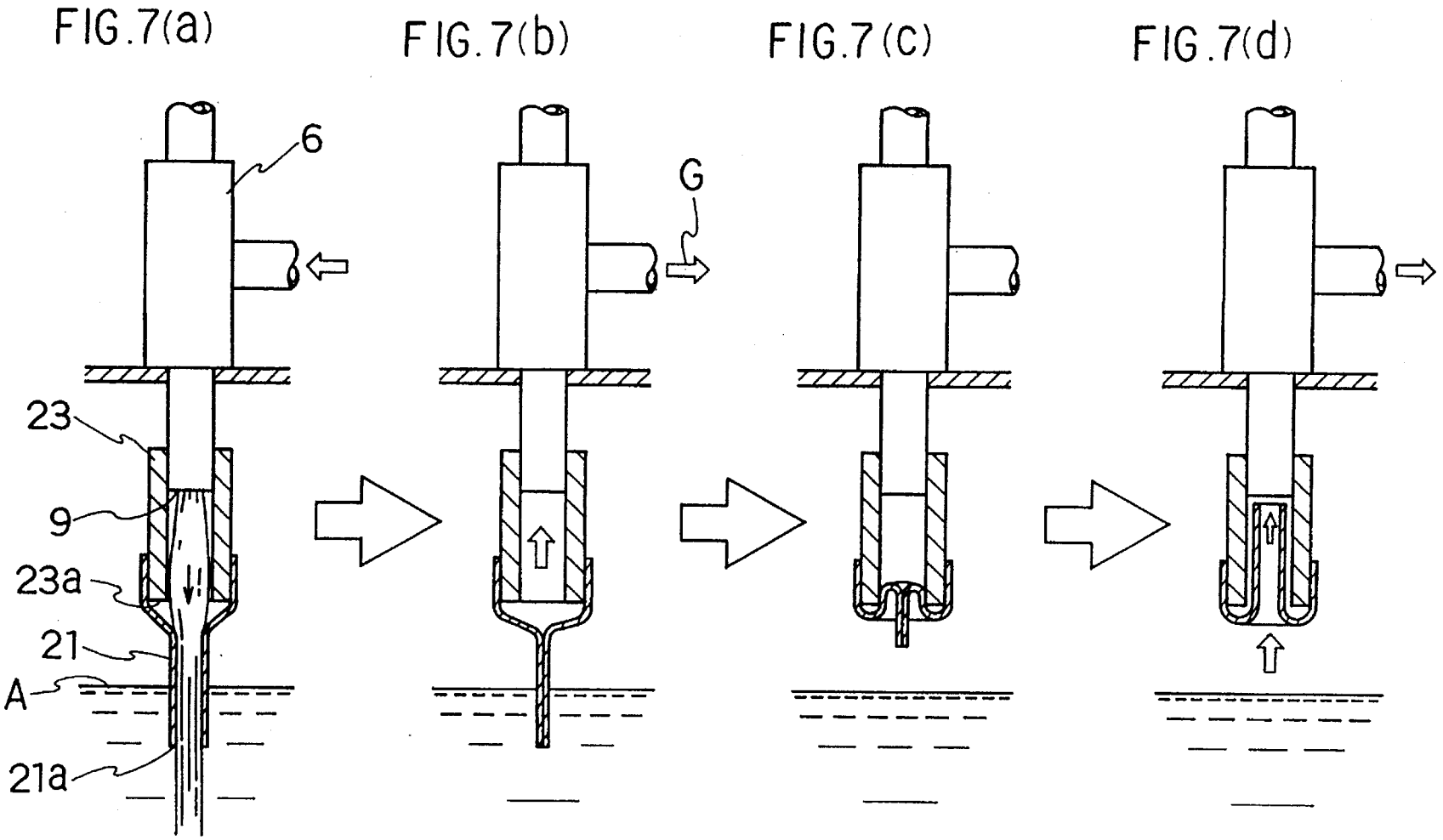
FIGS. 7(*a*), 7(*b*), 7(*c*), 7(*d*) are schematic representations of action of the reverse flow prevention mechanism of FIG. 6.
Figure 8B:
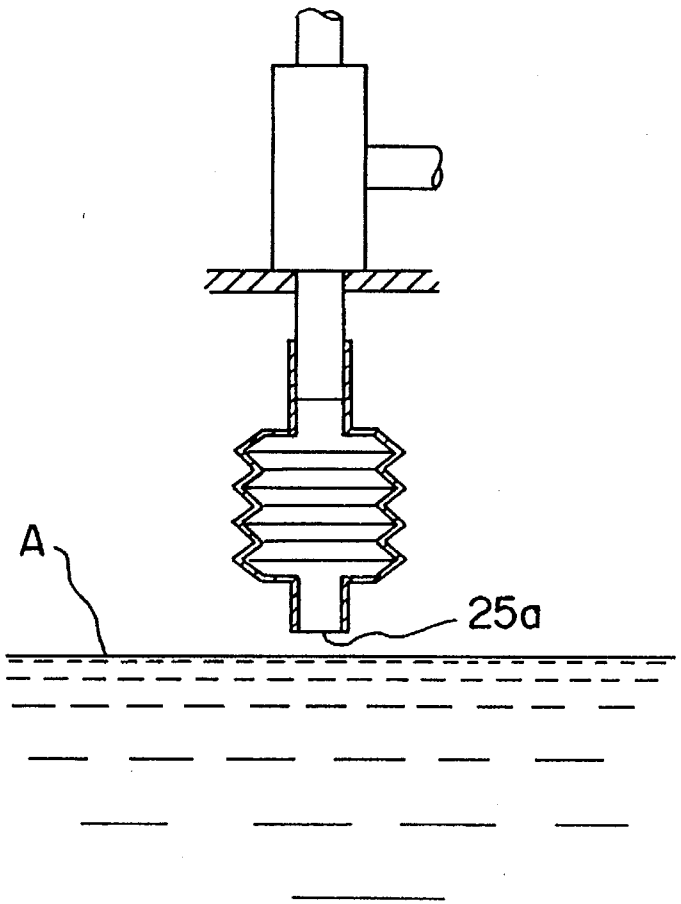
FIGS. 8(*a*) and 8(*b*) are schematic representations of constitution and action of still another embodiment of the reverse flow prevention mechanism of the apparatus for vacuum absorption according to the present invention.
Figure 8A:
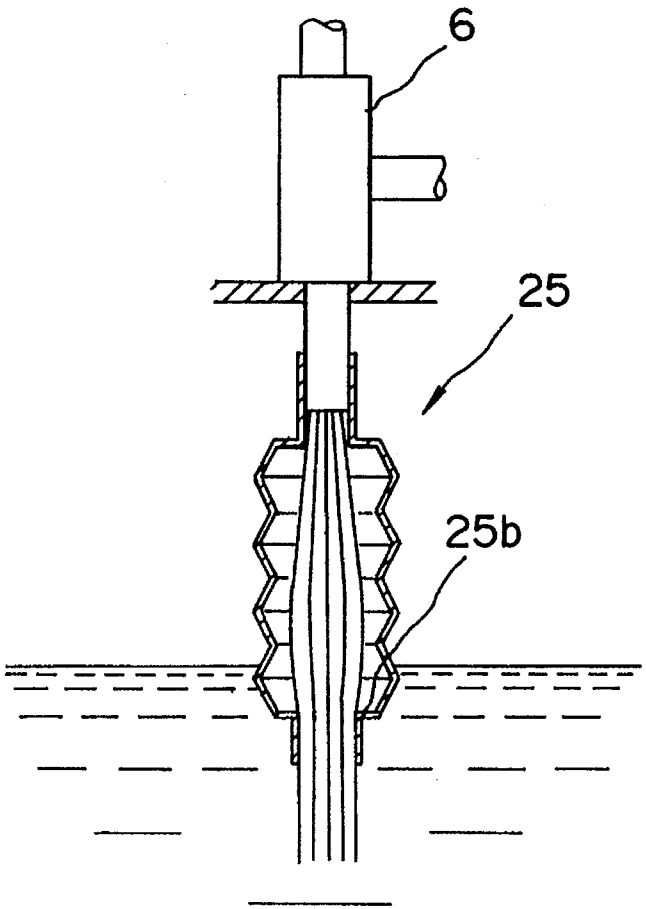
Figure 9B:
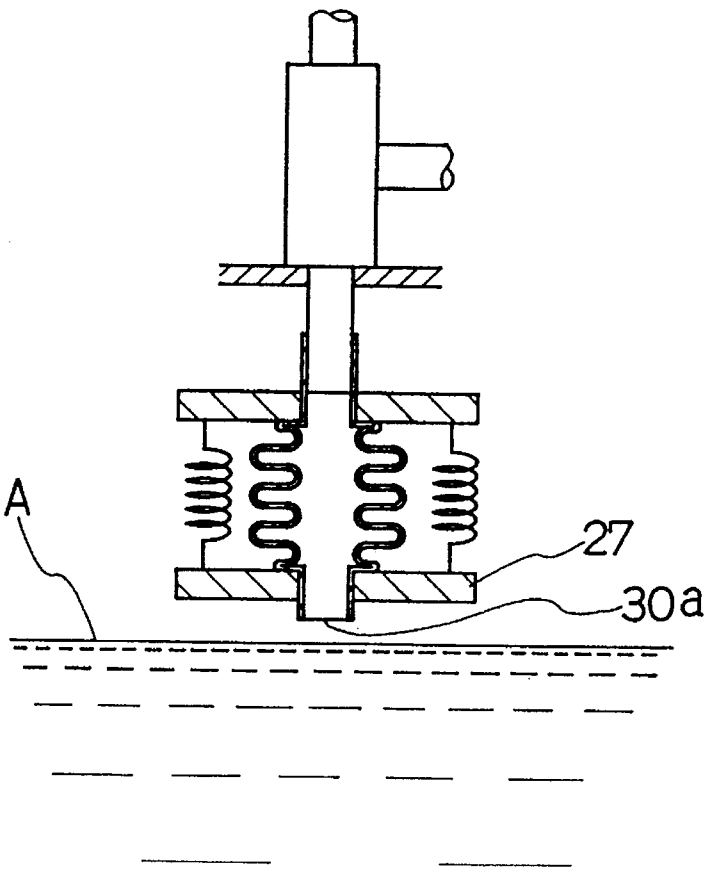
FIGS. 9(*a*) and 9(*b*) are schematic representations of constitution and action of yet another embodiment of the reverse flow prevention mechanism of the apparatus for vacuum absorption according to the present invention.
Figure 9A:
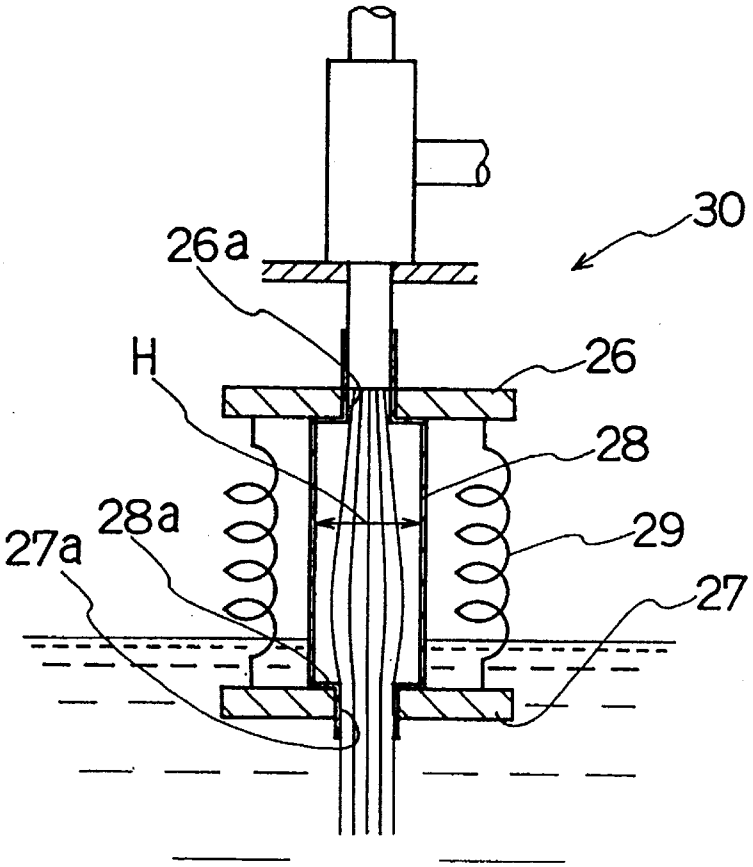

First, in case that the outlet is disposed over the water surface, the outlet is provided with the reverse flow prevention mechanism, and is designed to sink substantially under the water surface during operation of the pump and to be substantially over the water surface when the pump stops. Therefore, though the circulating water is drained into the water, the reverse flow of the circulating water is prevented because air is absorbed into the inside of the vacuum vessel through the outlet when the pump stops. As for this type of the reverse flow prevention mechanism, such involves the reverse flow prevention mechanism (hollow body) 8 in an apparatus for vacuum absorption 10 as shown in FIGS. 1 to 4, the reverse flow prevention mechanism 22 in an apparatus for vacuum absorption 20 comprising a rubber tube 21, as shown in FIGS. 5 to 7, or the reverse flow prevention mechanism 25 or 30 in an apparatus for absorption 20, as shown in FIGS. 8 or 9, comprising a flexible duct are taken into consideration.

Second, when the outlet is disposed under the water surface, the type of a reverse flow prevention mechanism wherein an air passage which absorbs air into the vacuum vessel is separately secured by providing a bypass tube 31 (refer to FIG. 10) or so is taken into consideration.

Figure 1:
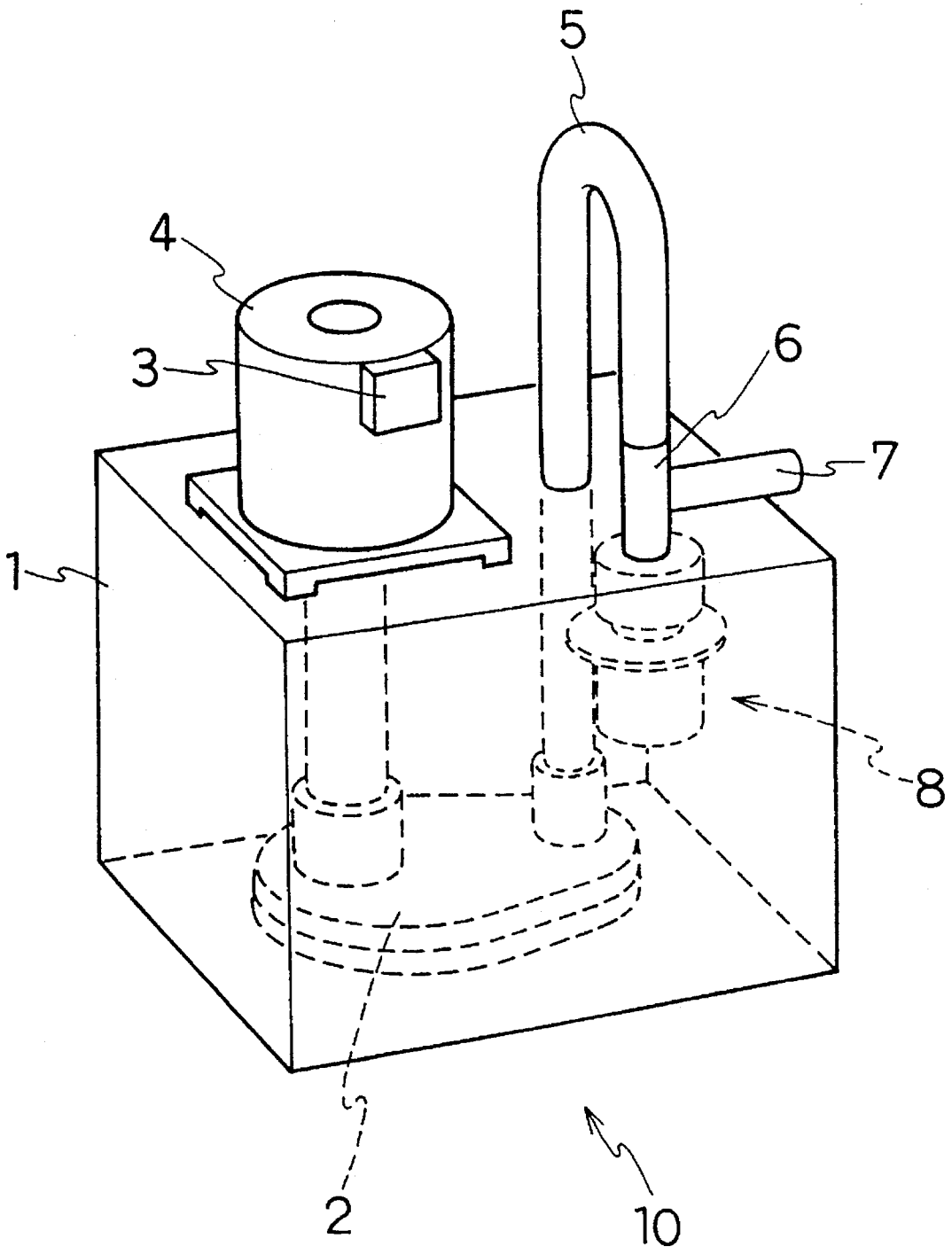
FIG. 1 is a perspective view of one embodiment of an apparatus for vacuum absorption according to the present invention.

At first, an apparatus for vacuum absorption 10 provided with a reverse flow prevention mechanism comprising a hollow body as (hereinafter referred to as "buffer") 8 according to the present invention is described with reference to FIGS. 1 to 4. In FIG. 1, numeral 1 is a tank, numeral 2 is a pump driven by a motor 4 including a condenser 3, numeral 5 is a waterway wherein circulating water accumulated in a tank 1 circulates in the inside thereof, the waterway being provided with a pump 2 at the side of the absorption inlet, and numeral 6 is an aspirator with an absorption passage 7 connecting a vacuum vessel to the aspirator.

Figure 2:
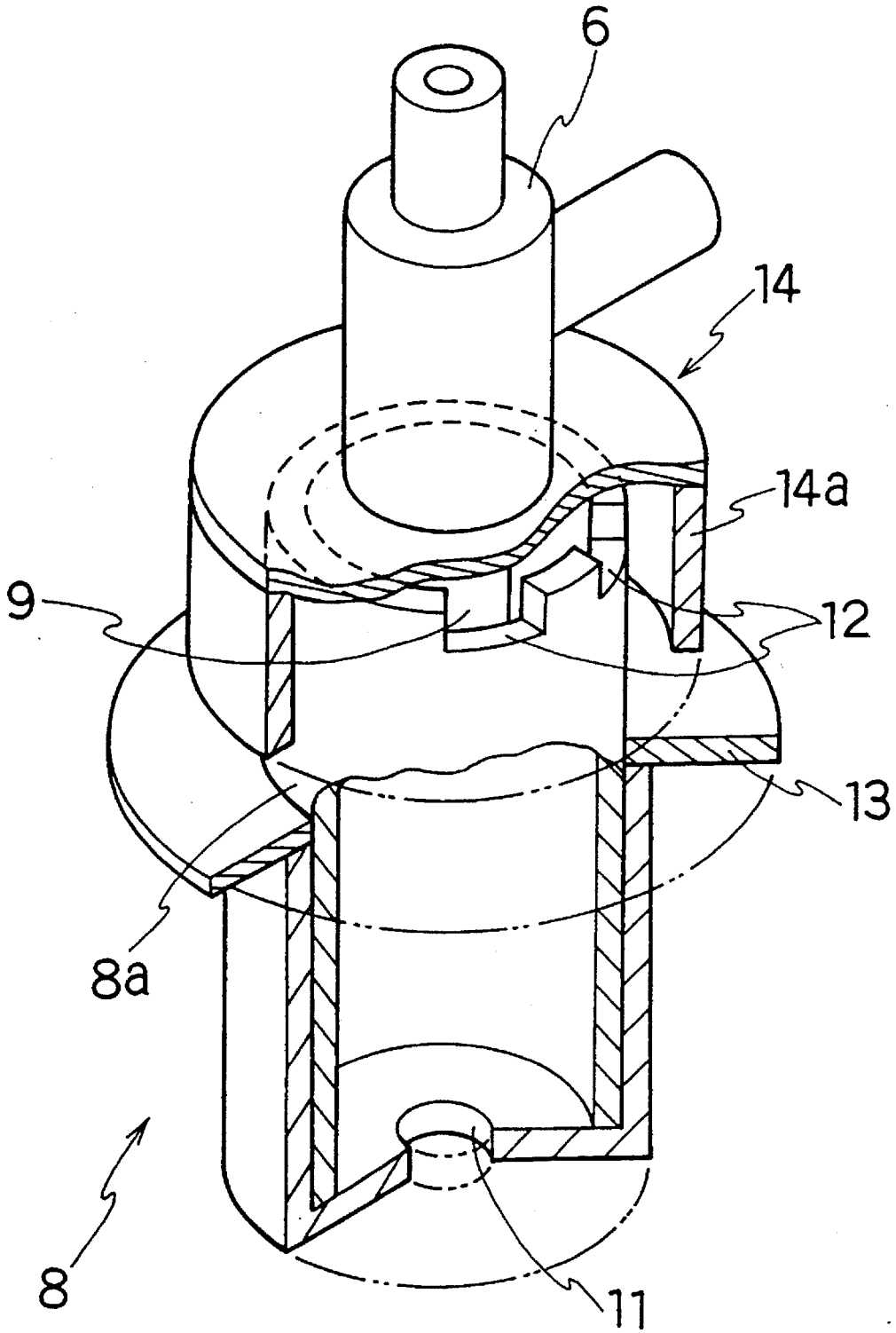
FIG. 2 is a partially cutaway perspective view of the reverse flow prevention mechanism of the apparatus for vacuum absorption of FIG. 1.

As shown in FIG. 2, the buffer 8 comprises a hollow body having a cavity in the inside thereof and includes an internal outlet 9. Further, the buffer 8 is provided with a small hole 11 in the bottom, drain windows 12 in the upper side and a wave prevention board 13 in the shape of doughnut at the outer side. The small hole 11 is preferably provided at the position to be sunk under the water surface and bored at the center of the base as shown in FIG. 2. Because forces given by the water current bursting forth are symmetrical, air is hard to be introduced into the tank. Still further, the size of the small hole 11 is designed to be able to only pass a lesser water volume than the volume drained from the outlet 9.

Figure 3A:
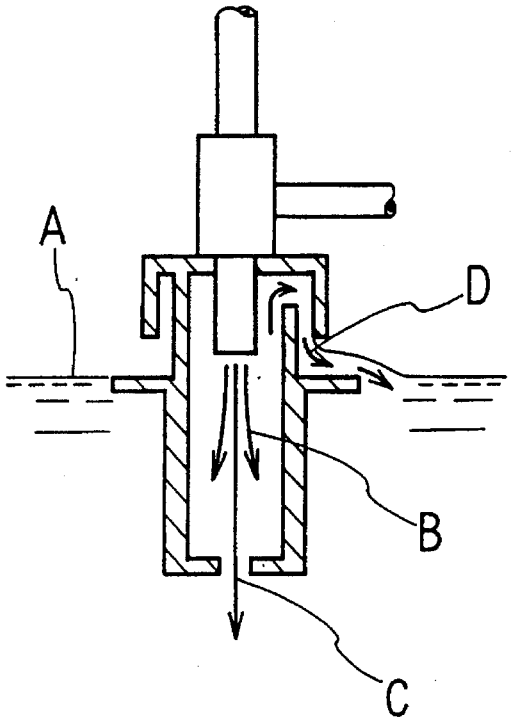
FIGS. 3(*a*) and 3(*b*) are sectional views representing action of the reverse flow prevention mechanism of FIG. 2.
Figure 3B:
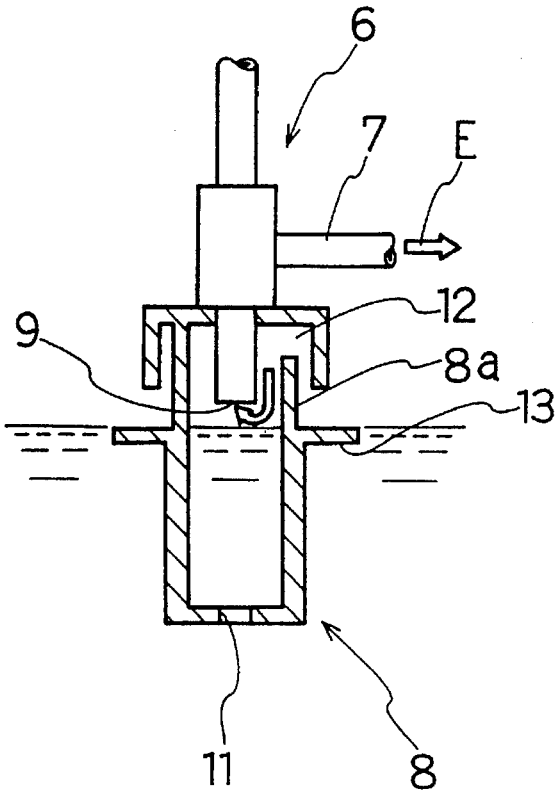

The drain window 12 is provided at a position over the water surface. The drain window 12 is provided in order to overflow the accumulating water in the buffer 8, which is drained from the outlet 9 but is not able to be drained from the small hole 11. Therefore, the drain window 12 is preferably covered with an upper lid 14 with a side part 14*a* extending downward. Then, since the water current goes along the outer side 8*a* of the buffer 8 as shown in FIG. 3(*a*), there is no fear of a large sound due to the scattering of water onto the water surface and the generation of bubbles due to involvement of air.

The wave prevention board 13 is provided at approximate center of the outer side 8*a* of the buffer 8 and at the same position of a water surface A of circulating water accumulated in the tank 1 (refer FIG. 3), whereby swelling of a water surface generated by circulating water overflowing from the drain window 12 can be prevented. The wave prevention board 13 can also prevent involvement of air generated by a current of circulating water spouting out from a small hole 11 into the water.

Still further, the outlet 9 of the aspirator 6 is provided inside the buffer 8 and at the position over a water surface A of circulating water accumulated in the tank 1. The buffer 8 is so mounted such that the near half thereof might sink under the water surface.

Next, the operation of the buffer 8 is explained with reference to FIG. 3. FIG. 3(*a*) shows a schematic side view of the buffer 8 during the operation of the pump, and FIG. 3(*b*) shows a schematic side view of the buffer 8 during the stoppage of the pump.

The circulating water flows out from the outlet 9 of the aspirator 6 during the operation of the pump (arrow B). A part of the circulating water flows out from the small hole 11 under the water surface of the tank (arrow C). But, the circulating water which is not drained from the small hole 11 overflows from the drain window 12 (arrow D) because the size of the small hole is too small to drain all of the circulating water. At this time, since the water surface in the buffer 8 has risen and the outlet 9 can be sunk in the water, the problems of generating noise, involving air or the like do not occur. Further when the pump is stopped, since the level of the water surface in the buffer 8 becomes equal to that of the water surface A and the outlet 9 appears is situated over the water surface, air is absorbed from the outlet 9 into the vacuum vessel through the absorption passage 7 (arrow E).

Figure 4:
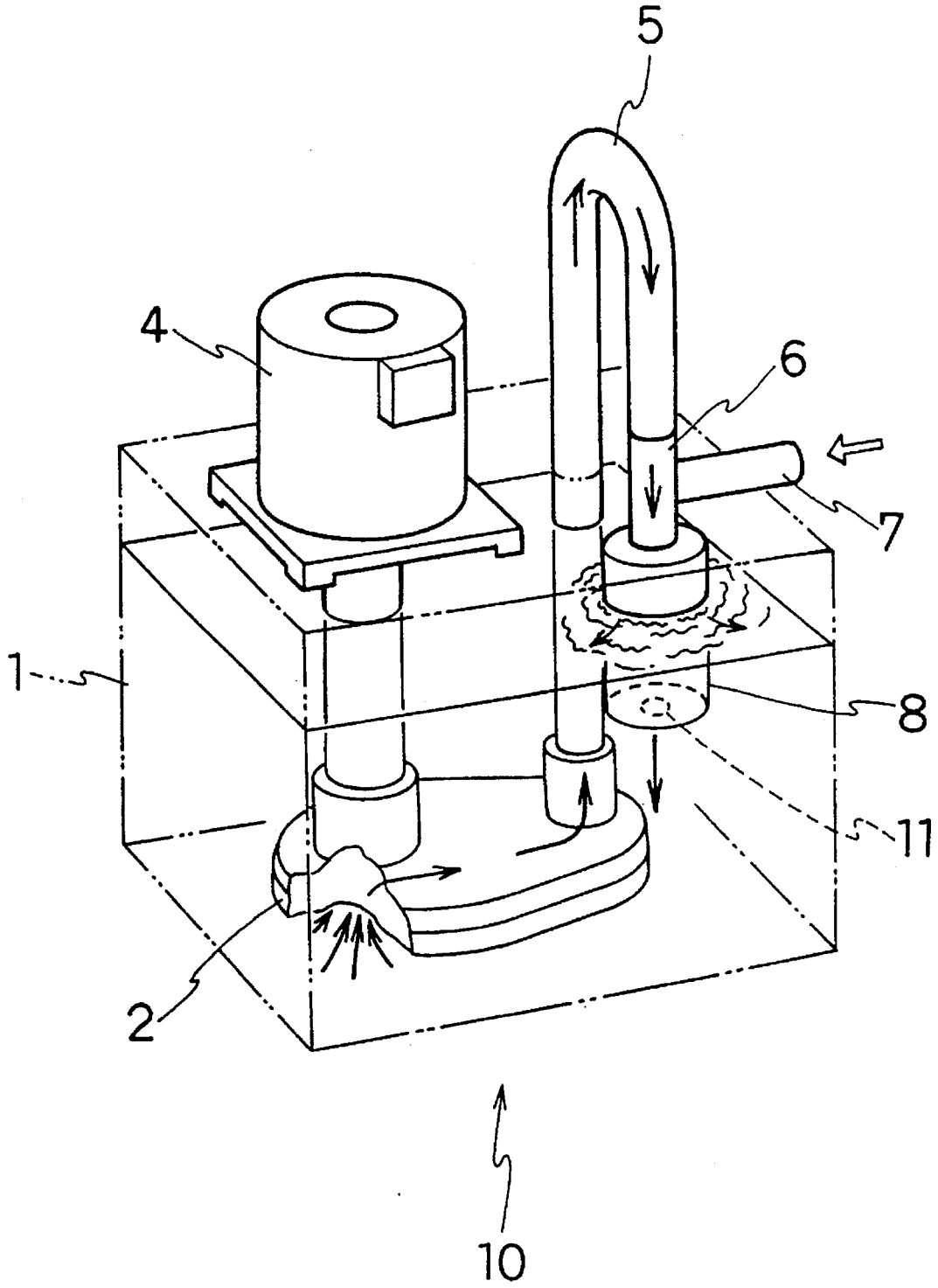
FIG. 4 is a schematic representation of action of the reverse flow prevention mechanism of FIG. 1.

FIG. 4 shows a current during the operation of the pump of the apparatus for vacuum absorption 10. The circulating water is accumulated in the tank 1. The water level is set so that the small hole 11 of the buffer 8 might sink in the water and the outlet 9 of the aspirator 6 provided in the buffer 8 might be situated over the water surface. When a switch of a motor 4 is set to ON, the pump 2 operates and the water pumped up by the pump 2 reaches to the aspirator 6 through the water passage 5 to be drained from the outlet 9. The aspirator 6 can evacuate the vacuum vessel (not shown) with this current, the vessel being connected to the aspirator 6 through the absorption passage 7. At this time, the outlet 9 in the buffer 8 is in the water (refer to FIG. 3(*a*)). When the switch of the motor 4 is set OFF, since the pump stops and the current stops, the level of the water surface in the buffer 8 becomes equal to that of the water surface of the tank 1 and the outlet 9 appears over the water surface (refer to FIG. 3(*b*)).

Next, another embodiment of an apparatus for vacuum absorption according to the present invention will be described with reference to FIG. 5.

This apparatus for vacuum absorption 20 is provided with a reverse flow prevention mechanism 22 comprising a rubber tube 21 in place of the buffer 8. FIG. 6 is a schematic representation of this reverse flow prevention mechanism 22 before assembly, wherein the rubber tube 21 is mounted to the aspirator 6 through a cylinder 23. As shown in FIG. 7, a tip 23*a* of the cylinder 23 is situated over the water surface A of the tank 1, and the rubber tube 21 attached to the tip 23*a* has a length to allow the tip 21*a* to reach under the water surface A of the tank 1.

The quality, the inside diameter, and the thickness of the rubber tube 21 are preferably determined so that the inside surface can be touched firmly and easily turned over by negative pressure in the vacuum vessel when the pump stops. Concretely, it is preferably made of a natural rubber, particularly silicone rubber. The inner diameter is not particularly limited but generally about 14 mm, and the thickness is generally about 0.1 mm.

In FIG. 6, the inner diameter F of the cylinder 23 at the side attached with the rubber tube 21 is preferably larger than the outer diameter of the rubber tube 21 because the rubber tube 21 turns over in the cylinder 23, and concretely the inner diameter F of the cylinder is preferably 15 to 20 mm when the outer diameter of the rubber tube is 14 mm and the thickness thereof is 0.1 mm. The cylinder 23 can be made of polyvinyl chloride (PVC).

Next, the operation of the reverse flow prevention mechanism 22 according to the rubber tube 21 will be described with reference to FIG. 7. When the pump 2 operates, the circulating water is drained from the outlet 9 and the vacuum vessel is evacuated. In that case, the tip 21*a* of the rubber tube 21 is situated under the water surface A of the tank 1 so that noise generated by the current and involvement of air are prevented (refer to FIG. 7(*a*)). When the pump 2 stops, negative pressure is operated toward the inside of the vacuum vessel (arrow G). The rubber tube 21 is firstly touched firmly by this negative pressure before the circulating water is drawn up (refer to FIG. 7(*b*)), secondly sucked up (refer to FIG. 7(*c*)), and finally turned over in the cylinder 23 (refer to FIG. 7(*d*)) to allow air to be absorbed into the vacuum vessel through the turned-over rubber tube 21.

Further, the reverse flow prevention mechanism 25 utilizing a flexible duct will be described with reference to FIGS. 8 and 9.

FIG. 8 is a schematic representation of the constitution and the action of the reverse flow prevention mechanism utilizing a flexible duct in the shape of bellows. This reverse flow prevention mechanism 25 comprises a cylindrical body involving plastics, waterproof cloth, and so on, which is stuck to a spring member such as a coil spring, or a bellows utilizing elasticity of plastics itself and so on. The tip of the reverse flow prevention mechanism 25 is situated over the water surface A of the tank 1 in a natural state as shown in FIG. 8(*b*) and is sunk under the water by the water pressure during the operation of the pump as shown in FIG. 8(*a*). In other words, when the pump is stopped, the reverse flow prevention mechanism 25 returns to the natural state by a restoring force thereof and air is absorbed from the tip 25*a* of the outlet situated over the water surface. Therefore, a pressured part 25*b*, which is situated inside and spreads vertically to the direction of the current so as to easily receive the current pressure, is preferably provided near the tip part 25*a*.

FIG. 9 is a schematic representation of the constitution and action of a reverse flow prevention mechanism 30 comprising a flexible duct having two plates 26, 27, a tube 28 and an elastic body 29. In this reverse flow prevention mechanism 30, the tip 30*a* is also situated over the water surface A in the tank 1 in a natural state as shown in FIG. 9(*b*) and is sunk under the water by the water pressure during the operation of the pump as shown in FIG. 9(*a*). When the pump is stopped, the reverse flow prevention mechanism 30 returns to the natural state by a restoring force of the elastic body 29 and air is absorbed from the tip 30*a* of the outlet appearing over the water surface. The tube 28 of this reverse flow prevention mechanism 30 connects the holes 26*a* and 27*a* of the two plates 26 and 27, and is made of a collapsible material. Therefore, it is preferably made of plastics in shape of bellows which has no restoring force. The inner diameter H of the tube 28 is also preferably larger than the diameter of the holes 26*a* and 27*a* (in particular 27*a*) of the plates in order to allow a narrowed part 28*a* to easily receive a current pressure.

The elastic body 29 plays a role to raise up the plate 27 at the side of the tip over the water surface in a natural state as shown in FIG. 9(*b*). Then, the elastic body 29 is preferable to be a spring member like a coil spring as shown in FIG. 9, and it is also possible to utilize synthetic rubber, natural rubber or so which are elastic at a room temperature, and a magnetic force, a gas cushion (an object restoring by air pressure of sealed air in a piston or the like) or the like. Not less than two elastic body 29 are preferably spaced equally and circumferentially around water current so that a distance between the plates 26 and 27 is uniform.

In the above arrangement shown in. FIGS. 8 or 9, it is also noiseless and quiet during the operation of the pump because circulating water is drained into the water and the performance of the aspirator 6 is coincidentally not reduced because air is not involved. Because the outlet is situated over the water surface, air is absorbed into the vacuum vessel through the outlet and therefore the circulating water does not flow reversely.

Figure 10:
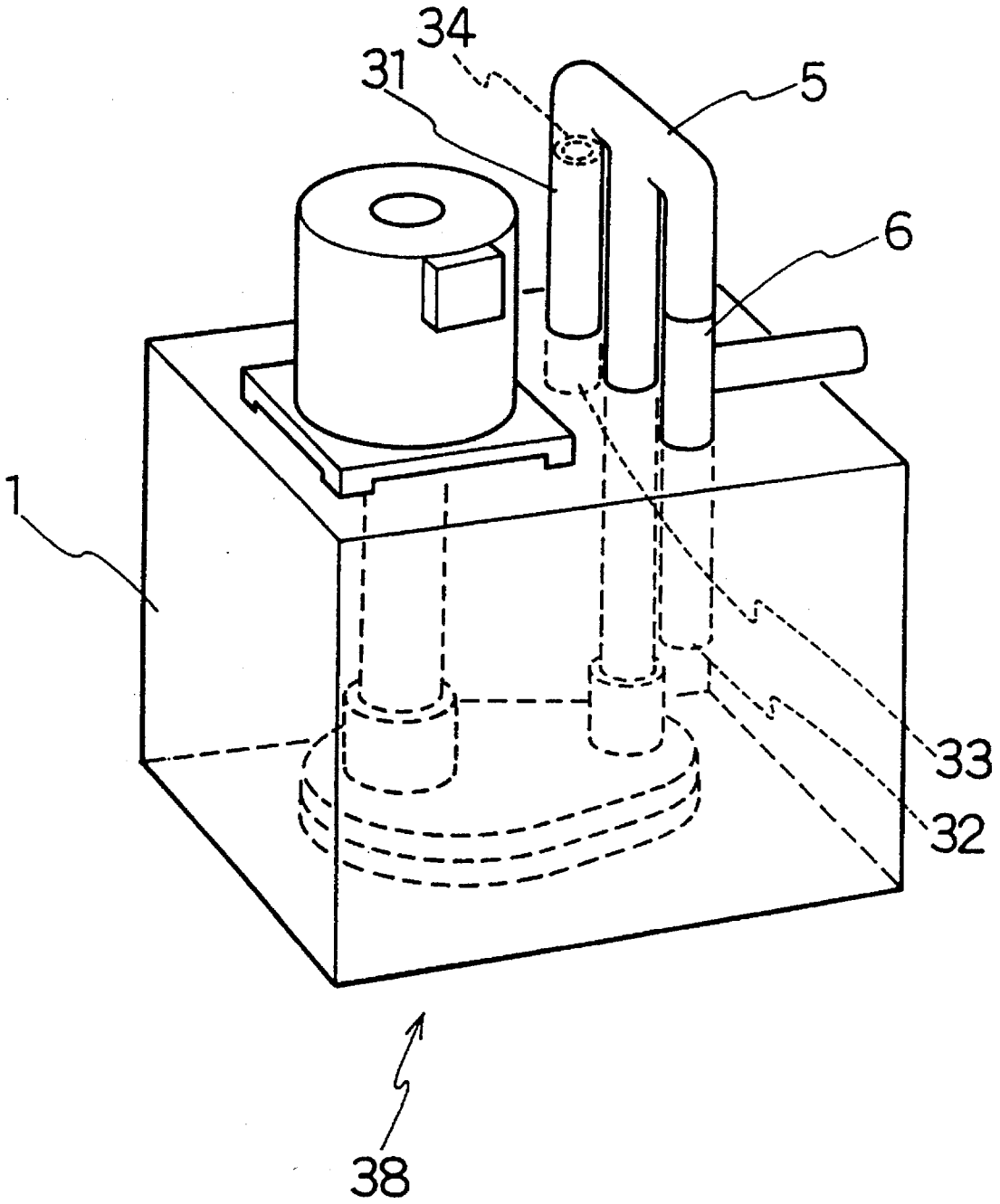
FIG. 10 is a perspective view of another embodiment of an apparatus for vacuum absorption according to the present invention.
Figure 12:
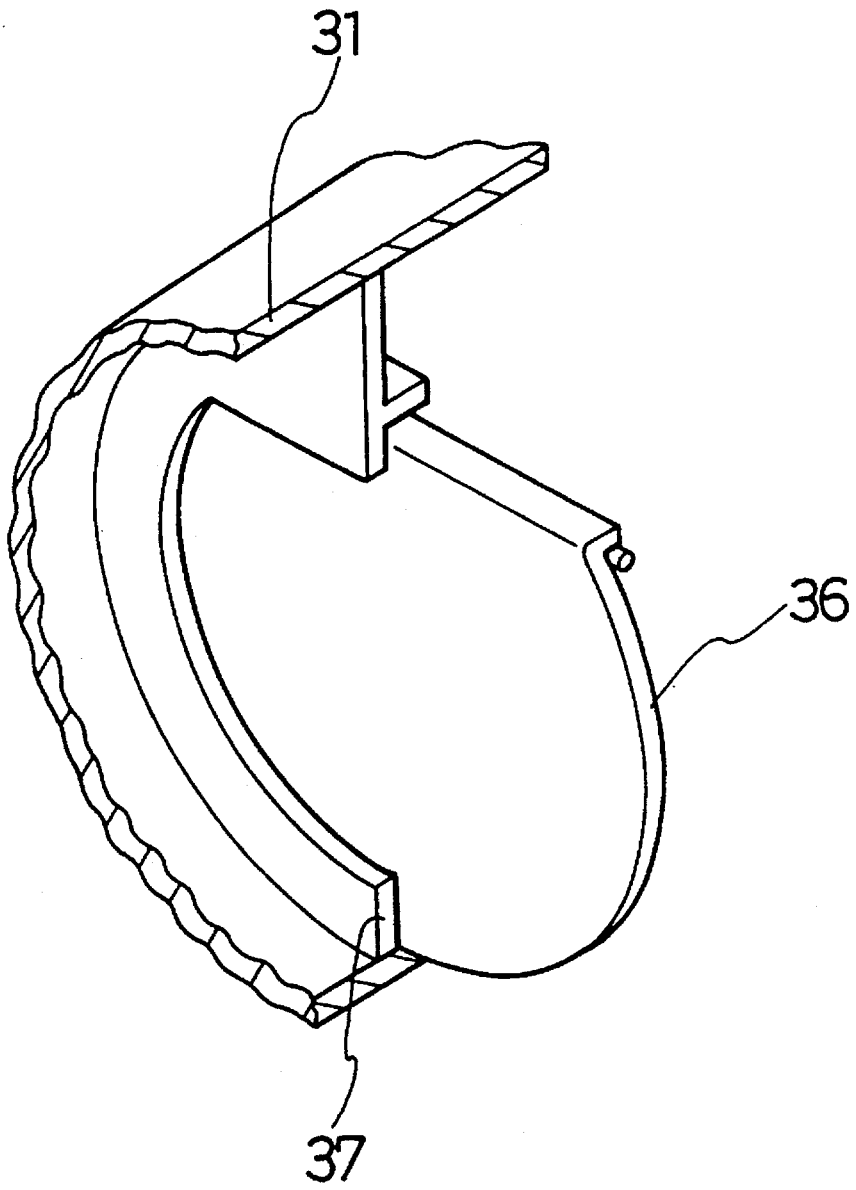
FIG. 12 is a perspective view of the valve shown in FIG. 11.

Next, an apparatus for vacuum absorption 38, which is provided with the outlet 32 under the water surface and the bypass tube 31 in the waterway 5, is explained with reference to FIG. 10.

The bypass tube 31 is extended from the upstream side of the aspirator 6 to the upper part of the tank 1, and an opening 33 of the tip thereof is disposed over the upper part of the tank 1 and above the water surface of the circulating water. A valve 34 is disposed in the inside thereof.

As shown in FIG. 11, the valve 34 disposed in the bypass 31 is can be to open only to the right direction on the drawing. That is, as shown in FIG. 11(*a*), the valve 34 is closed by the current pressure and the circulating water is drained into the water from the outlet 32 disposed under the water surface during the operation of the pump. As shown in FIG. 11(*b*), when the pump 2 stops, since the inside pressure of the vacuum vessel is negative, the inside of the waterway 5 also becomes negative. The valve 34 opens so that the air is absorbed from an opening 33 into the vacuum vessel 35 through the upper part of the aspirator 6. Therefore, there is not a fear that the circulating water invades from the outlet 32.

Further, since enough water pressure does not operate to the valve 34 at the beginning of the operation of the pump 2 and therefore the valve does not sufficiently close, the circulating water is apprehended to pass through the bypass tube 31. Then, the opening 33 at the tip of the bypass tube 31 is preferably directed to the upper part of the tank 1, but the opening 33 might be directed to the outside of the tank 1 if it is opened to the atmosphere.

Figure 14A:
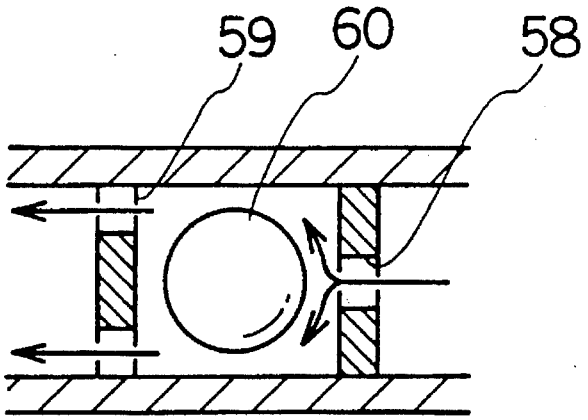
FIG. 14(a) PRIOR ART
FIGS. 14(*a*) and 14(*b*) are schematic representations of a section of an one-way mechanism in FIG. 13.
Figure 14B:
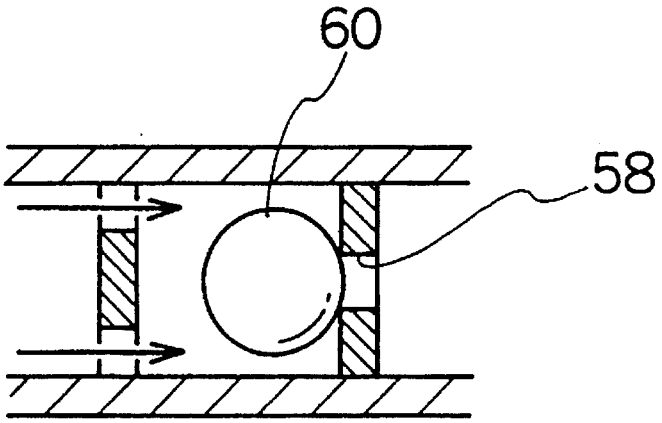
FIG. 14(b) PRIOR ART
Figures 15A, 15B:
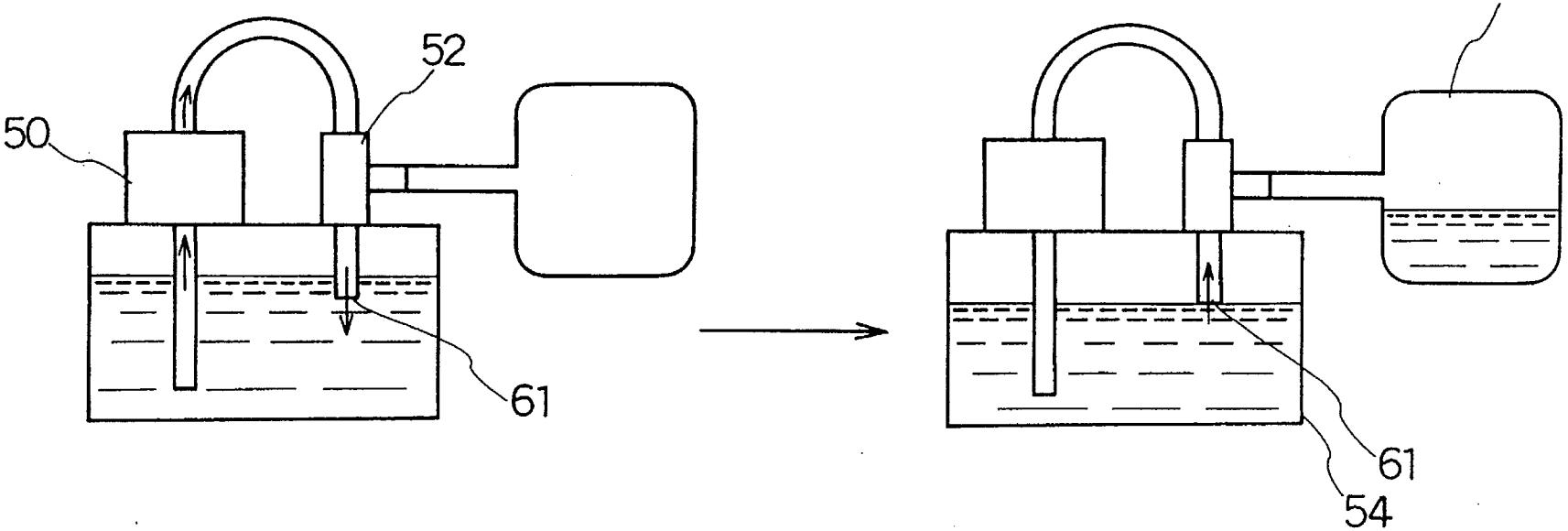
FIG.15(b) PRIOR ART
FIG.15(a) PRIOR ART
FIGS. 15(*a*) and 15(*b*) are schematic representations of problems occurred in the case of simplification of a conventional apparatus for vacuum absorption.
Figure 16B:
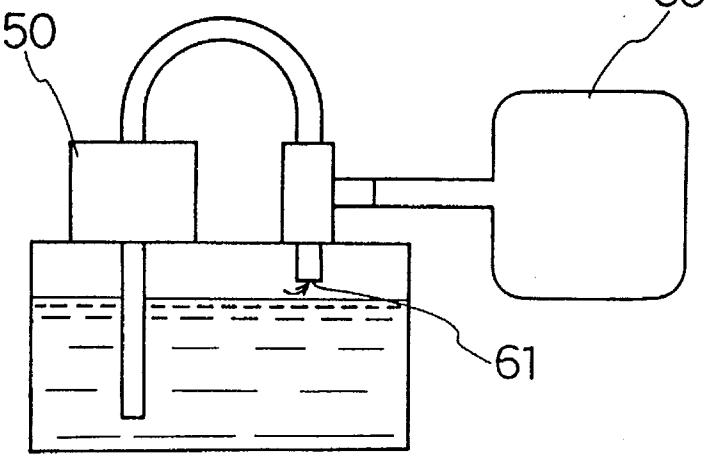
FIG.16(b) PRIOR ART
FIGS. 16(*a*) and 16(*b*) are also schematic representations of problems occurred in the case of simplification of a conventional apparatus for vacuum absorption.
Figure 16A:
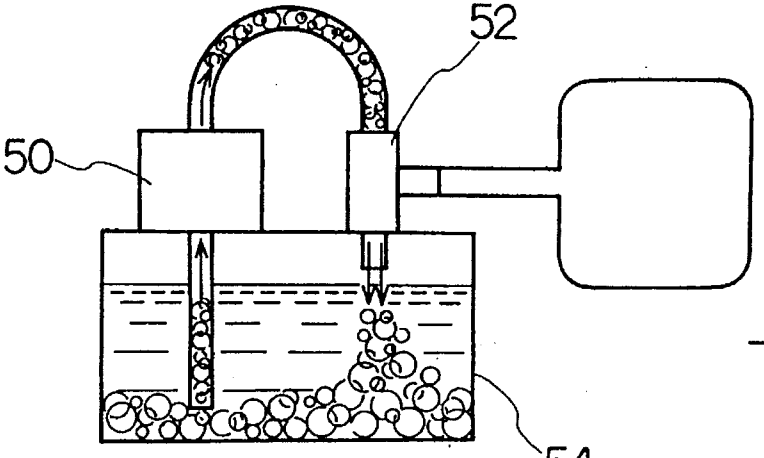
FIG. 16(a) PRIOR ART

Still further, as for the valve 34, a valve plate 36, which is supported on an annular pedestal 37 and can open and close, as shown in FIG. 14 or a conventional one-way mechanism shown in FIG. 14 or so are employable. The valve 34 might be so designed as to close at the time of ON and open at the time of OFF in connection with On and OFF of the motor 4.

As has been described, in the apparatus for vacuum absorption, the inside of the vacuum vessel is evacuated and is kept in vacuum by the operation of the pump, and returns to the atmospheric pressure with the stoppage of the pump. Accordingly, since the inside of the vacuum vessel can be evacuated and can be returned to the atmospheric pressure only by ON and OFF of the switch provided to the motor which drives the pump, the operation is easy and the system is simplified.

The reverse flow prevention mechanism drains the circulating water to the water during the operation of the pump and introduces the air into the vacuum vessel upon the stoppage of the pump. Accordingly, it is quiet because the drained water is not apprehended to make a noise, and bubbles are not generated and the performance of the aspirator is not reduced because the air is not apprehended to be involved into the circulating water. Moreover, the circulating water does not flow reversely by the negative pressure of the vacuum vessel when the pump is stopped.

While only certain presently preferred embodiments have been described in detail, as will be apparent with those familiar with the art, certain changes and modifications can be made without departing from the spirit and scope of the invention as defined by the following claims.

What is claimed is:

1. An apparatus for vacuum absorption, comprising:

a tank for accumulating water;

a waterway for circulating the water in the tank;

a pump disposed at an absorption inlet side of the waterway;

an aspirator disposed on the waterway;

a reverse flow prevention mechanism for preventing the circulating water from flowing reversely into a vacuum vessel connected to the aspirator during the stoppage of the pump and for introducing air from the aspirator into the vacuum vessel; wherein the reverse flow prevention mechanism is disposed proximate an outlet of the waterway and includes means to drain the circulating water directly into the water at a level below the water surface during the operation of the pump and to absorb air into the waterway in a reverse direction to the flow of water at a level above the water surface into the vacuum vessel during the stoppage of the pump;

wherein the outlet of the waterway is disposed over the water surface of the circulating water in the tank, and the reverse flow prevention mechanism is disposed at the outlet of the waterway; and wherein the reverse flow prevention mechanism includes a hollow body having drain windows positioned above the water surface and having a small hole sized to drain a lesser volume of water than the volume flowing out of the outlet of the waterway, said small hole being positioned sunk under the water surface.

2. The apparatus of claim 1, wherein the reverse flow prevention mechanism has, at an outer side thereof, a wave prevention board projecting along the water surface of the circulating water in the tank.

* * * * *